United States Patent [19]

Magee, Jr. et al.

[11] Patent Number: 4,671,352

[45] Date of Patent: Jun. 9, 1987

[54] APPARATUS FOR SELECTIVELY INJECTING TREATING FLUIDS INTO EARTH FORMATIONS

[75] Inventors: Robert L. Magee, Jr., Fort Worth; Marvin B. Traweek, IV, Arlington, both of Tex.

[73] Assignee: Arlington Automatics Inc., Grand Prairie, Tex.

[21] Appl. No.: 899,873

[22] Filed: Aug. 25, 1986

[51] Int. Cl.[4] ..... E21B 33/124; E21B 34/12

[52] U.S. Cl. ..... 166/186; 166/127; 166/129; 166/147; 166/191; 166/373; 166/334

[58] Field of Search ..... 166/147, 142, 126, 127, 166/128, 129, 143, 133, 188, 186, 183, 191, 196, 373, 387, 334

[56] References Cited

U.S. PATENT DOCUMENTS

| | | | |
|---|---|---|---|
| 2,290,441 | 7/1942 | McGaffey | 166/186 X |
| 2,493,962 | 1/1950 | Gray | 166/186 X |
| 2,717,041 | 9/1955 | Brown | 166/186 X |
| 3,169,579 | 2/1965 | Haines | 166/186 X |
| 3,361,204 | 1/1968 | Howard et al. | 166/186 X |
| 3,391,743 | 7/1968 | Bateman | 166/186 X |
| 3,467,184 | 9/1969 | Young | 166/129 |
| 3,493,052 | 2/1970 | Evans et al. | 166/373 |
| 3,517,743 | 6/1970 | Pumpelly et al. | 166/127 |
| 4,567,944 | 2/1986 | Zunkel et al. | 166/191 X |
| 4,569,396 | 2/1986 | Brisco | 166/191 X |

*Primary Examiner*—Stephen J. Novosad

[57] ABSTRACT

In the representative embodiment of the invention described herein, formation-treating apparatus is adapted to be dependently supported in a well bore from a pipe string and which includes upper and lower telescoped body members adapted to be selectively moved between upper and lower operating positions for controlling the injection of treating fluids into one or more earth formations traversed by the well bore. A pair of spaced packer elements are mounted on the lower member above and below a discharge port and cooperatively arranged for isolating a well bore interval that is to be treated by discharging one or more treating fluids in the pipe string from the port. To control the injection of treating fluids, retrievable valve means are also cooperatively arranged within the body members and adapted to be alternatively seated on upper and lower full-bore valve seats in the upper and lower bodies in response to movement of the bodies to their operating positions. In this manner, whenever the upper body member is moved to one of its operating positions, the valve means will be seated on the lower valve seat and unseated from the upper valve seat to open fluid communication between the pipe string and the treating tool. On the other hand, whenever the upper body member is moved to its other operating position, the valve means will be seated on the upper valve seat to trap treating fluids in the pipe string and discharge any unused fluids into the well bore.

19 Claims, 13 Drawing Figures

APPARATUS FOR SELECTIVELY INJECTING TREATING FLUIDS INTO EARTH FORMATIONS

BACKGROUND OF THE INVENTION

This invention relates to new and improved well bore apparatus which is cooperatively arranged to be dependently suspended in a well bore from a pipe string and selectively operated for injecting treating fluids into one or more earth formations. More particularly, the present invention involves a new and improved fluid-treating tool including full-bore valve means comprised of upper and lower members which are telescoped together and adapted for cooperatively receiving a retrievable valve member having upper and lower valve elements adapted to be alternatively seated on upper and lower valve seats in response to movement of the telescoped members between spaced operating positions for selectively controlling the injection of treating fluids from discharge ports located between spaced packer means cooperatively arranged around the lower member for isolating a selected well bore interval that is being treated.

BACKGROUND ART

In the course of readying a well to produce oil or gas it is often necessary to inject various treating compounds into one or more of earth formations containing the connate fluids. Typically, such treating operations are carried out by setting a packer for isolating the formations to be treated from the well bore fluids above the packer. Pumps at the surface are operated thereafter as necessary for pumping treating fluids through the tubing string supporting the packer and into the isolated well bore interval by way of one or more perforations which have been previously made to establish communication with those formations of interest which are penetrated by the well bore. Once it is believed that a sufficient volume of treating fluids has been forced into the formations of interest, the packer is unseated and either returned to the surface or moved to another interval in the well bore that penetrates additional formations that are in need of treatment.

Those skilled in the art recognize, however, that it can not be necessarily assumed that the treating fluids have been equally distributed in the formations being treated since these fluids often enter some perforations more readily than others in the same perforated interval. Thus, for many treating operations it is considered necessary to increase the pumping pressures for the treating fluids with the expectation that the fluids will ultimately be forced through all of the perforations in the well bore interval. Increased pumping pressures can, however, produce needless damage in some earth formations. On the other hand, with those wells where the formations are highly permeable, often it is not possible to increase the pumping rate sufficiently to raise the injection pressure to the pressure level necessary to be certain that the treating fluids are actually entering all of the earth formations in that particular interval of the well bore.

To avoid unwanted formation damage, one common treating technique is to pump a quantity of so-called "ball sealers" into the well bore along with the treating fluids so that as the balls begin to temporarily block those perforations that have initially accepted the treating fluids, the pumping pressure can then be progressively increased with the expectation that the treating fluids will then be forced into the other perforations which were initially partially plugged. This technique is, however, not always completely successful since it is dependent upon the ball sealers moving to and sealing the perforations that accept the treating fluids.

Another common treating technique is to employ a so-called "straddle packer" having a pair of closely-spaced packer elements that are cooperatively arranged to isolate only a few perforations lying between the packer elements. In this manner, by successively setting the straddle packer at different depth locations in the well bore, only a limited number of perforations will be isolated at any given time so that the pumping pressure can be selectively controlled as needed to inject the treating fluids into each successive set of perforations without damaging other formations. Nevertheless, those skilled in the art will recognize that such straddle-packer treating tools have not been fully successful. For instance, many straddle-packer tools use a spring-biased check valve as a flow restrictor. Experience bas shown, however, that these check valves frequently tend to leak and some of the treating fluids remaining in the tubing string after one operation will be lost as the treating tool is being moved to another position in the well bore. Since these check valves are also easily plugged by loose scale or debris in the supporting tubing string, at times it may be necessary to delay or terminate a treating operation in order to remove the plugging materials.

With any type of treating tool, it must be recognized that quite often a substantial quantity of the treating fluids will be left in the tubing string at the completion of a treating operation. Thus, something must be done with these remaining fluids before the packer is unseated and then either repositioned or returned to the surface. With some prior-art treating tools, the remaining treating fluids must be pumped out of the tubing string before the packing element or elements are unseated. With other prior-art tools, there is no alternative but to waste the unused treating fluids by dumping them into the well bore. Ii neither of these steps can be taken, then as the treating tool is being retrieved from the well bore, the treating fluids remaining in the tubing string will be spilled onto the rig floor as each stand of the tubing is disconnected at the surface. Obviously none of these situations are desirable.

It should also be realized that few, if any, straddle-packer treating tools are appropriately arranged whereby wireline tools such as a through-tubing perforator can be lowered through the treating tool into the well bore therebelow. Thus, with such prior-art treating tools, it has been necessary to temporarily remove the treating tool so that a remedial operation can be performed before the treating operation is again resumed. This obviously represents an additional expense that could be avoided if the treating tool had an uninterrupted axial passage.

OBJECTS OF THE INVENTION

Accordingly, it is an object of the present invention to provide new and improved well bore apparatus for selectively injecting treating fluids into earth formations without unduly risking potential damage to these or other adjacent formations.

It is a further object of the invention to provide new and improved formation-treating apparatus that is cooperatively arranged to provide unrestricted access to the well bore below the apparatus.

It is still another object of the present invention to provide new and improved fluid-treating apparatus which is easily controlled from the surface for retaining unused treating fluids in the supporting tubing string as the treating apparatus is being moved to a different location in a well bore as well as for discharging unwanted fluids remaining in the apparatus into the well bore before moving the apparatus.

SUMMARY OF THE INVENTION

These and other objects of the present invention are attained by providing new and improved fluid-treating apparatus adapted to be dependently suspended in a well bore from a pipe string, with this apparatus including upper and lower full-bore valve means having an upper body member which is adapted to be coupled to the pipe string and is telescopically arranged in relation to a lower body member for movement between spaced upper and lower operating positions. The upper and lower valve means further include an elongated retrievable valve member having upper and lower valve elements cooperatively arranged thereon to be alternatively seated on upper and lower valve seats within the upper and lower body members. Means are cooperatively arranged on the retrievable valve member and the upper body for shifting the valve member between its respective longitudinally-spaced operating positions in response to selected movements of the tubing string for alternatively seating the lower valve element on its associated lower seat and seating the upper valve element on the upper seat. Wall-engaging anchor means are also arranged for frictionally securing the lower member against the well bore casing so that the pipe string can be manipulated as needed to selectively shift the valve member between its upper and lower positions. The new and improved treating apparatus also includes fluid-discharge means situated between upper and lower wall-engaging packing means that are cooperatively arranged on the lower body member and adapted to be sealingly engaged with the well bore casing for isolating a perforated interval therein that is in communication with one or more earth formations that are to be treated.

In this manner, when the fluid-treating apparatus of the present invention has been positioned in a well bore with the packer elements isolating a selected well bore interval, the tubing string can be moved for shifting the valve member to one operating position for closing communication between the treating apparatus and the well bore below the packer elements and opening communication between the tubing string and the fluid-discharge means so that treating fluids may be injected into the formations adjacent to the isolated well bore interval. When the tubing string is moved thereafter for shifting the valve member to its other operating position, communication is closed between the tubing string and the treating apparatus to retain any treating fluids remaining in the tubing string and fluid communication is opened between the apparatus and the well bore to drain leftover treating fluids in the treating apparatus before it is moved to a new position in the well bore or returned to the surface.

Although the objects of the present invention can be readily attained by coupling the upper and lower valve means to various types of typical full-bore packers, it is preferred to arrange the treating apparatus of the present invention as a unitary assembly of upper and lower full-bore valve bodies which are tandemly interconnected to one another by the mandrel of a straddle packer having a typical assembly of upper and lower packer elements supported on telescoping body members carrying a frustoconical slip expander and a plurality of slips which are moved outwardly into anchoring engagement with the casing wall as the packer mandrel is moved downwardly to expand the packing elements into sealing engagement with the casing. To facilitate the movement of the treating tool within a well bore, the tool is preferably further provided with upper and lower bypass valve means cooperatively arranged to be closed as the mandrel is moved to set the packer elements and slips against the casing.

BRIEF DESCRIPTION OF THE DRAWINGS

The novel features of the present invention are set forth with particularity in the appended claims. The invention, together with furtber objects and advantages thereof, may best be understood by way of illustration of the following description of exemplary apparatus employing the principles of the present invention as illustrated in the accompanying drawings, in which:

DESCRIPTION OF A PREFERRED EMBODIMENT

Figure 1A:
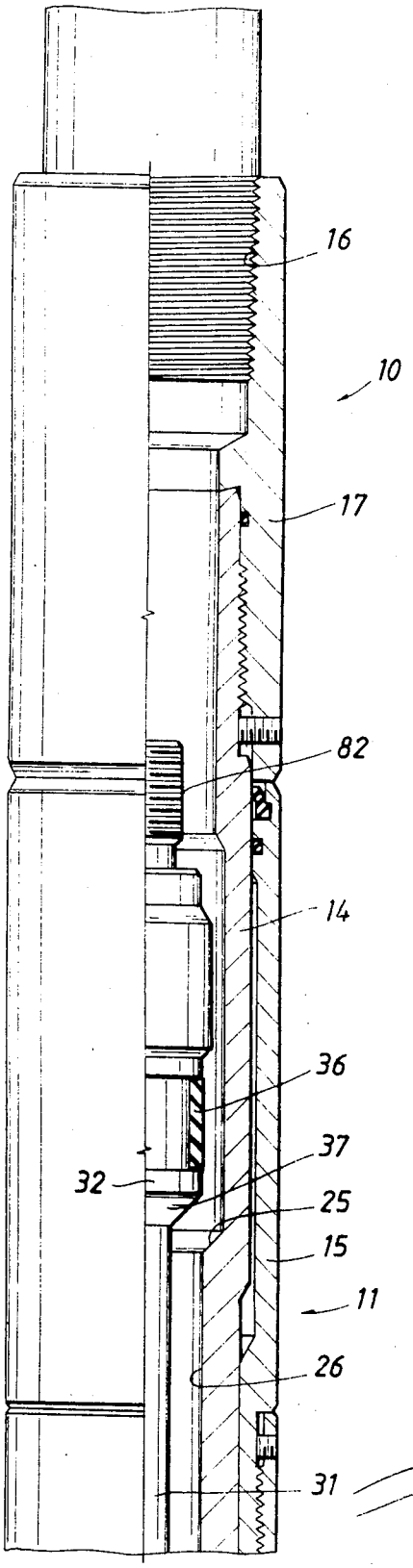
FIGS. 1A–1F are successive partially cross-sectioned elevational views which together show a preferred embodiment of the new and improved formation-treating apparatus of the present invention in its so-called "running-in position", with FIGS. 1A–1B depicting the upper full-bore valve means of the treating apparatus, FIGS. 1C–1E showing a preferred embodiment of a packer means which may be incorporated into the new and improved treating apparatus of the invention, and FIG. 1F illustrating a preferred embodiment of the lower full-bore valve means of the present invention.
Figure 1B:
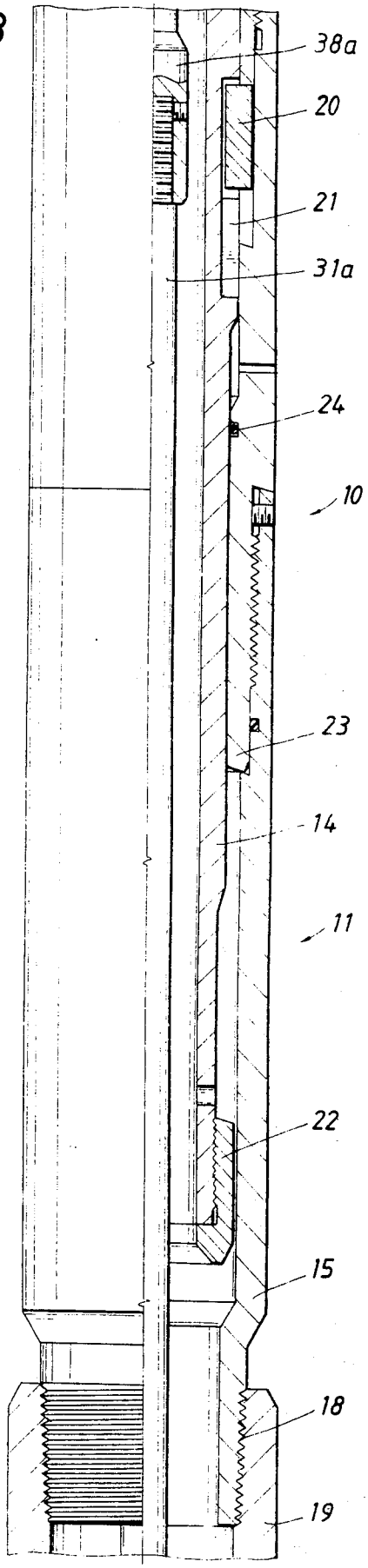
Figure 1C:
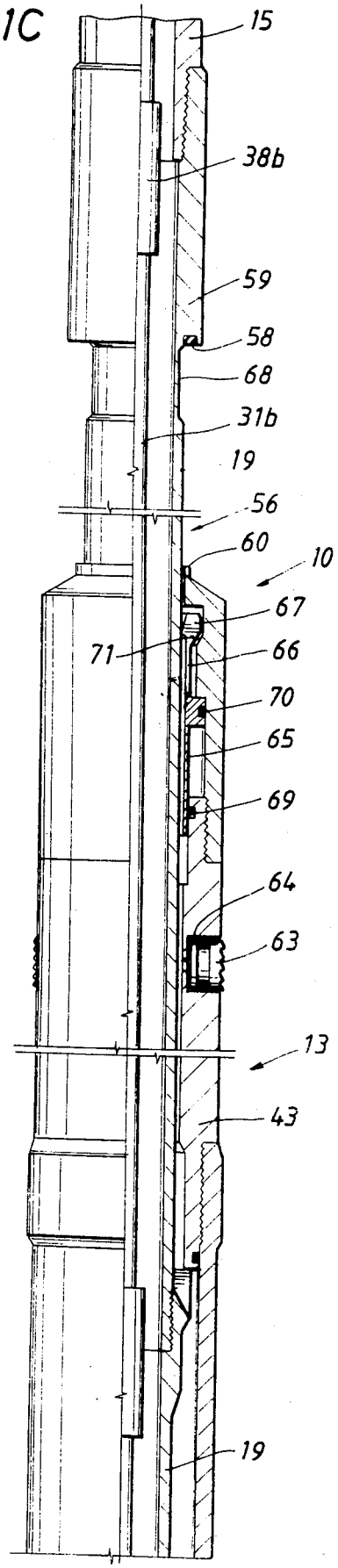
Figure 1D:
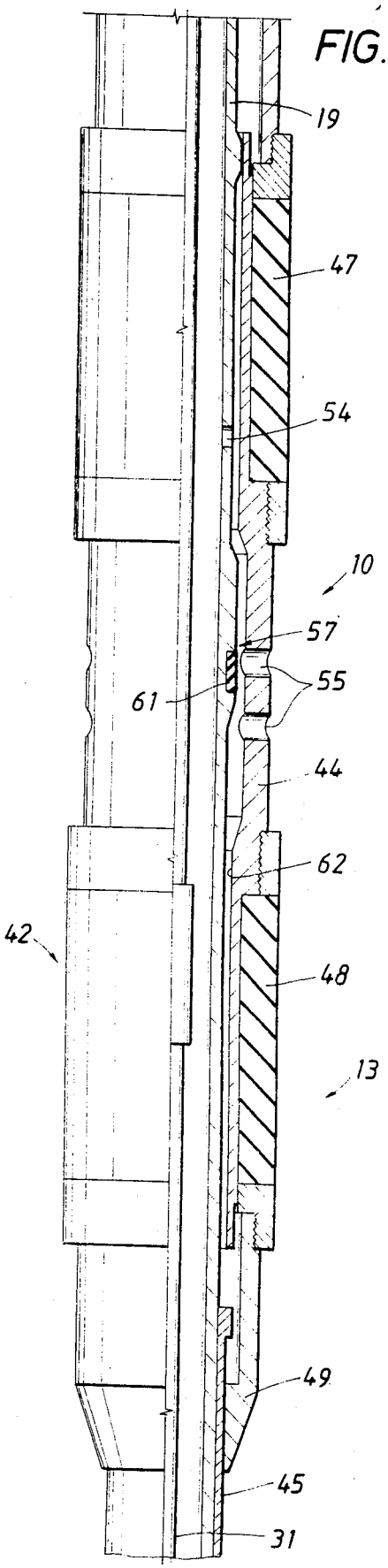
Figure 1E:
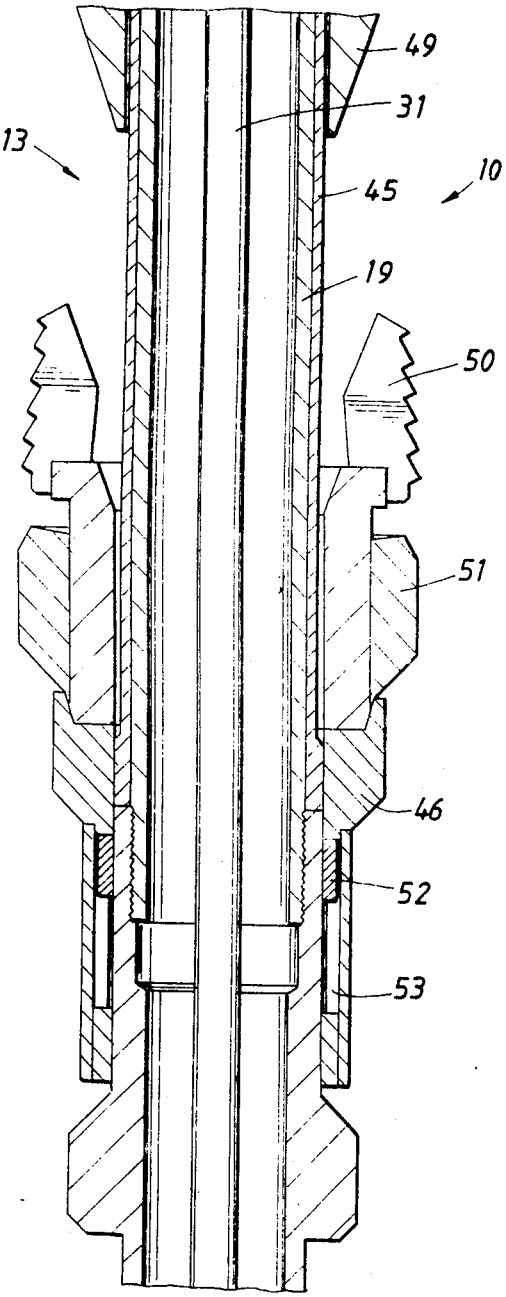
Figure 1F:
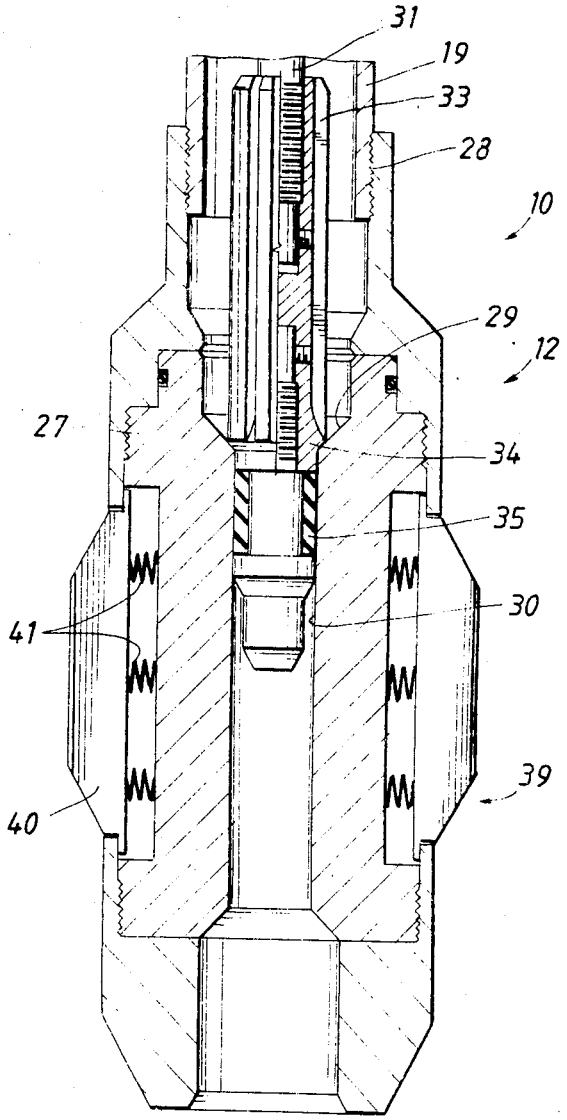

Turning now to FIGS. 1A–1F, successive, partially cross-sectioned elevational views are respectively shown of the upper, lower and intermediate portions of a preferred embodiment of new and improved fluid-treating apparatus 10 incorporating the principles of the invention as it is preferably arranged for carrying out a treating operation in a typical cased well bore. As respectively depicted in these drawings, the fluid-treating apparatus 10 is generally comprised of upper full-bore valve means 11 (as seen in FIGS. 1A–1B) and lower full-bore valve means 12 (as seen in FIG. 1F) that are tandemly interconnected to one another by full-bore packer means which (as generally shown at 13 in FIGS. 1C–1E) is preferably a typical straddle packer. Those skilled in the art will, of course, recognize that different typical design details may be employed to fashion a tool of this nature. Accordingly, to facilitate the following description of the fluid-treating apparatus 10, various typical constructional details of a minor nature have been somewhat simplified in the accompanying drawings where possible to do so without affecting the full and complete disclosure of the present invention.

As illustrated in FIGS. 1A–1B, the upper valve means 11 include a tubular mandrel 14 that is telescopically disposed within an elongated tubular body 15 and adapted for being moved longitudinally in relation thereto between spaced upper and lower operating positions. Internal threads 16 are cooperatively arranged within an enlarged-diameter upper portion 17 of the mandrel 14 for dependently coupling the treating apparatus 10 to the lower end of a tubing string. Similarly, external threads 18 on the lower end of the tubular body 15 are arranged for coupling the upper full-bore valve means 11 to the upper end of a mandrel 19 of the straddle packer 13 therebelow.

The upper full-bore valve means 11 further include an inwardly-directed J-pin 20 that is mounted within the tubular body 15 and slidably disposed within a typical J-slot which is cooperatively arranged on the exterior of the mandrel 14 so as to define a short vertical locking portion 21 which is cooperatively arranged to receive the J-pin when the mandrel is to be retained in its illustrated lower or telescoped operating position as best determined by the engagement of the lower face of the enlarged mandrel shoulder 17 with the upper end of the tubular body. As is typical, the J-slot for the upper valve means 11 also includes an elongated longitudinal portion (not seen in FIG. 1B) that is parallel to and angularly displaced from the locking portion 21 and cooperatively arranged to permit the mandrel 14 to be rotated slightly and moved upwardly in relation to the valve body 15 to an upper or extended operating position where the upper face of an enlarged-diameter shoulder 22 on the lower end of the mandrel engages an inwardly-directed shoulder 23 in the intermediate portion of the valve body. Sealing means, such as an O-ring 24, are cooperatively arranged between the body and the mandrel to block communication between the interior and exterior of the telescoped valve members 14 and 15. The upper end of the axial bore in the mandrel 14 is counterbored to define an upwardly-facing shoulder 25 that is located just above a smaller-diameter valve seat 26 in the mandrel bore.

As seen in FIG. 1F, the lower valve means 12 of the apparatus 10 of the present invention include an outer tubular body 27 having internal threads 28 arranged within its upper end for dependently coupling the lower full-bore valve means to the lower end of the packer mandrel 19. It will also be noted from FIG. 1F that the longitudinal bore through the valve body 27 is counterbored for defining an upwardly-facing annular shoulder 29 immediately above a smaller-diameter seating surface 30 in the axial bore.

By comparing FIG. 1A with FIG. 1F it should be seen that the upper and lower valve means 11 and 12 further include an elongated valve member such as a rod 31 which has upper and lower enlarged head portions 32 and 33 that are cooperatively sized and arranged to be coaxially disposed within the internal bores of the upper and lower valve bodies 15 and 27 and an intermediate portion of sufficient length to extend completely through the central bore of the packer mandrel 19. As depicted in FIG. 1F, the lower valve means 12 are arranged with the lower head 33 of the rod 31 having an enlarged shoulder 34 on its upper end that is adapted to be supported on the shoulder 29 in the body 30 and a seal member 35 on its lower end that is adapted to be sealingly received within the lower valve seat 30 when the elongated rod is in its depicted lower position. As shown in FIG. 1A, the upper valve means 11 are further arranged so that as the mandrel 14 is moved upwardly within the valve body 15, a seal member 36 on the enlarged upper head 32 of the rod 31 will be sealingly received within the upper valve seat 26 as the upwardly-facing shoulder 25 on the valve mandrel is moved into engagement with a downwardly-facing shoulder 37 on the upper head of the rod. To be certain that the lower and upper seals 35 and 36 will be alternatively seated on their respective valve seats 30 and 26, the overall length of the elongated rod must be appropriately arranged so that when the valve mandrel 14 is in its illustrated telescoped position and the shoulder 34 on the lower end of the rod 31 is resting on the shoulder 29 in the lower valve means 12, the upper seal member 36 will be slightly above the upper valve seat 26. Moreover, the opposed shoulders 25 and 37 on the mandrel 14 and the rod 31 must also be arranged so that when the valve mandrel is raised toward its elevated position, these opposed shoulders will be coengaged and the rod will be raised sufficiently to lift the lower seal 35 out of the lower valve seat 30 before the valve mandrel reaches its fully-extended or upper operating position. It should also be noted that the shoulder 34 as well as the lower head 33 must be sized to easily pass through the upper valve seat 26. This will enable the rod 31 to be removed from or positioned within the treating apparatus 10 as needed during the course of a treating operation.

As a further feature of the present invention, it will be seen in the drawings that the elongated rod 31 is preferably arranged as a series of individual sections, as at **31*a* and 31*b*, which are tandemly interconnected by means of threaded couplings as at 38*a* and 38*b*. By arranging the rod 31 to be assembled from a plurality of individual sections of different lengths, it will be recognized that the overall length of the assembled elongated rod can be readily increased or reduced as needed to insure that the seal members 36 and 35 can be sealingly engaged within their respective upper and lower valve seats 26 and 30. It should also be noted that by arranging the elongated rod 31 as an assembly of separate elements which are to be tandemly coupled together, the separate elements can be readily uncoupled and replaced with other rod elements of different lengths as needed to accommodate various longitudinal spacings between the upper and lower valve means 11 and 12 such as may be accomplished when one or more tubular subs (not seen in the drawings) of different lengths have been coupled between the packer 13 and one or both of the valve means. The flexibility permitted by this unique arrangement of the upper and lower valve means 11 and 12 of the invention also enables the packer 13 to be arranged as needed for spanning well bore intervals of different lengths which are to be treated by using the new and improved treating apparatus 10**.

In the preferred embodiment of the present invention, wall-engaging restraining means 39 are cooperatively arranged on the lower valve means 12 and adapted for frictionally restraining the body 27 of the lower valve means with respect to the well casing to enable the upper valve body 15 and the packer mandrel 19 to be moved in relation to the lower valve body. Although various types of typical restraining devices can, of course, be employed without departing from the scope of the invention, it is preferred that the wall-engaging restraining means 39 be arranged as a so-called "collar locator" preferably having two or more upright lugs or keys, as at 40, which are mounted at spaced intervals around the body 27 and normally biased outwardly by means, such as a plurality of springs 41, into sliding engagement with the wall of the casing as the treating apparatus 10 is moved through a well bore. By sizing the outer edges of the keys 40 to partially enter the inwardly-opening recesses defined between the opposed ends of adjacent joints of the well casing and the collar coupling the joints together, as the keys are biased outwardly into these recesses an additional drag will be imposed on the movement of the treating apparatus 10.

Thus, by monitoring typical load-sensing instruments (not shown in the drawings) that are coupled to the upper end of the tubing string supporting the treating apparatus 10, the operator can readily detect when the movement of the treating apparatus is momentarily impeded as the collar locator keys 40 successively enter these recesses between adjacent joints in the casing string as the new and improved apparatus is being moved through the well bore. Since it is common practice to have a so-called "collar log" which shows the locations of the collars in a given string of casing in relation to the producing formations penetrated by the well bore, those skilled in the art will appreciate that the the load-sensing monitor can be efficiently employed to determine the position of the treating apparatus 10 in a given well bore by positioning the apparatus at a depth that is estimated to be just below a given casing collar and slowly raising the treating apparatus in the well bore until the monitor shows that the collar locator keys 41 have entered the recess defined by a casing collar that is at a known depth. This will, of course, indicate that the fluid-treating apparatus 10 is then positioned in a known relationship with respect to a particular formation interval. Once the depth of the treating apparatus 10 is confirmed in this manner, a treating operation can then be conducted with a reasonable certainty that this given formation interval is being treated. Thereafter, the treating apparatus 10 can be readily raised in the well bore by a selected distance; and the operator will be reasonably certain that the packer means 13 have been accurately repositioned and are ready to isolate the next formation interval that is to be treated.

Turning now to FIGS. 1C–1E, a preferred embodiment of is shown of the packer means 13 which are incorporated into the new and improved fluid-treating apparatus 10 of the present invention. Those skilled in the art will, of course, appreciate that although other types of full-bore straddle packers could be arranged as the packer means for the treating apparatus 10, the packer 13 depicted in the drawings will meet all requirements for achieving the objects of the present invention. The straddle packer 13 is illustrated in its so-called "running-in" position and in readiness to be lowered into a well bore to be sealingly engaged with the adjacent wall of the well casing. As previously described by reference to FIGS. 1A–1B and 1F, the tubular mandrel 19 of the packer means 13 is tandemly coupled between the upper and lower valve means 11 and 12. As shown in FIGS. 1C–1E, in the illustrated preferred embodiment of the invention, the packer mandrel 19 is movably mounted within a typical settable packer assembly 42 comprised of telescopically-arranged upper, intermediate and lower tubular body members 43–46 carrying spaced upper and lower elastomeric packer elements 47 and 48 that are cooperatively associated with a frusto-conical slip expander 49 and a plurality of slips 50 with drag blocks 51 respectively adapted to be moved outwardly into engagement with the casing upon downward travel of the packer mandrel for supporting the packer elements as they are successively expanded into sealing engagement with the casing. As is typical, an outwardly-directed J-pin 52 is arranged on the lower end of the packer mandrel 19 so as to be cooperatively received in a suitable J-slot 53 on the lower body 46 so that, with the J-pin in its depicted position, the mandrel 19 is secured in relation to the telescoped packer body members 43–46 until the mandrel is rotated slightly for positioning the J-pin in a longer longitudinal slot portion (not seen in the drawings) that will enable the mandrel to be moved downwardly in relation to the packer bodies. Fluid-discharge means including fluid ports, as at 54 and 55, are respectively arranged in the packer mandrel 19 and the intermediate packer body 44 so that a treating fluid can be injected into the well bore between the packer elements 47 and 48.

In the preferred embodiment of the packer means 13, upper and lower bypass valve means 56 and 57 are cooperatively arranged for controlling the fluid communication between the interior of the telescoped packer body members 43–46 and the well bore. As seen in FIG. 1C, the upper bypass valve means 56 of the packer means 13 are cooperatively arranged to be closed when the pipe string is slacked off for moving the upper valve means 11 and the packer mandrel 19 toward their respective lower positions to set the packer slips 50 and successively expand the spaced packer elements 47 and 48 against the casing. The upper bypass valve means 56 are preferably arranged in a typical manner by arranging a downwardly-facing seal member 58 on an enlarged-diameter shoulder 59 on the upper end of the mandrel 19 for being engaged on an upstanding annular seat 60 on the upper end of the upper Packer body 43 when the packer mandrel is moved downwardly from its depicted elevated position to a telescoped position for closing off communication between the pipe string and the well bore annulus above the upper packer element 47.

As illustrated in FIG. 1D, the lower packer bypass valve means 57 are preferably arranged to include a seal member 61 that is cooperatively mounted around an intermediate enlarged-diameter portion of the mandrel 19 and adapted, upon the downward movement of the packer mandrel from its illustrated elevated position to its lower telescoped position, to be carried into sealing engagement within a complementary valve seat 62 that is arranged in the intermediate packer body 44 just below the acid discharge ports 55 for closing off fluid communication around the outside of the packer mandrel 19 to the well bore below the lower packer element 48.

In the depicted preferred embodiment of the packer means 13, as shown in FIG. 1C two or more pressure-actuated holddown buttons, as at 63, are respectively arranged in lateral bores 64 spaced around the upper packer body 43 and cooperatively adapted to be moved outwardly against the casing by the increased pressure of the treating fluids for anchoring the settable packer assembly 42 in relation to the casing. To secure the mandrel 19 in its lower operating position while pressured treating fluids are being injected, a tubular collet member 65 with upstanding flexible fingers, as at 66, is cooperatively arranged within the upper packer body 43 so that inwardly-directed enlarged heads 67 on the upper ends of the collet fingers can move into a reduced-diameter recess 68 formed around the upper end of the packer mandrel as it is moved downwardly from its illustrated elevated position to its telescoped operating position. To provide a restraining force that is sufficient to hold the mandrel 19 against upward movement during a treating operation, sealing means 69 are arranged in the upper packer body 43 for sealingly engaging the lower portion of the collet member 65 and piston means 70 are arranged on the upper portion of the collet member. In this manner, as treating fluids are injected from the mandrel ports 54, the pressured treating fluids can pass between the collet fingers 66 and impose a downward force on the upper face of the piston means 70 so that as the collet member is moved downwardly, a bevelled surface 71 in the packer body 43 will move the enlarged collet heads 67 inwardly into locking engagement within the mandrel recess 68.

Figure 2A:
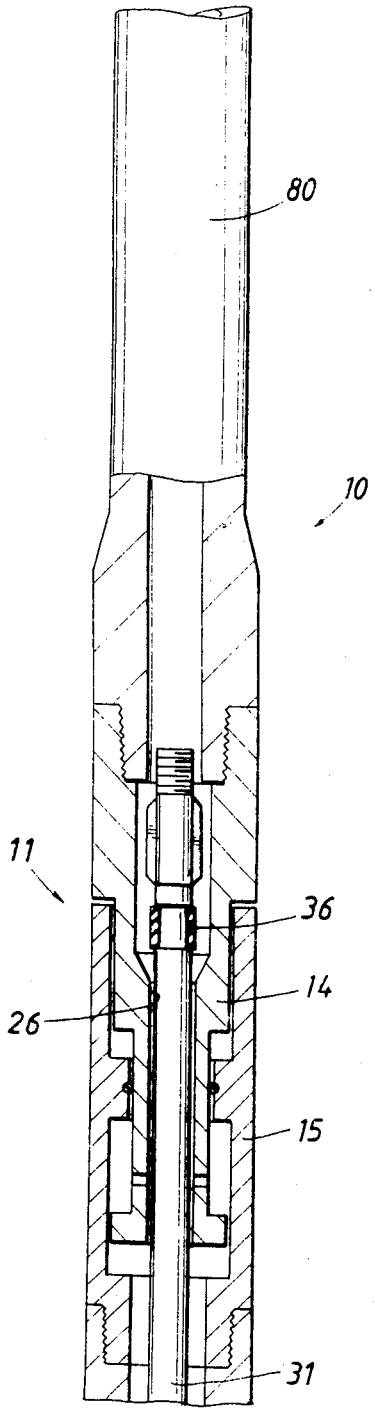
FIGS. 2A–2B, 3A–3B and 4A–4B schematically depict the new and improved fluid-treating apparatus of the invention as it is being successively operated during the course of a typical treating operation, with FIGS. 2A–2B illustrating the apparatus in readiness to be lowered into a well bore, and FIGS. 3A–3B showing the treating apparatus as it will appear during a typical treating operation, and FIGS. 4A–4B showing the apparatus after a treating operation has been completed.
Figure 2B:
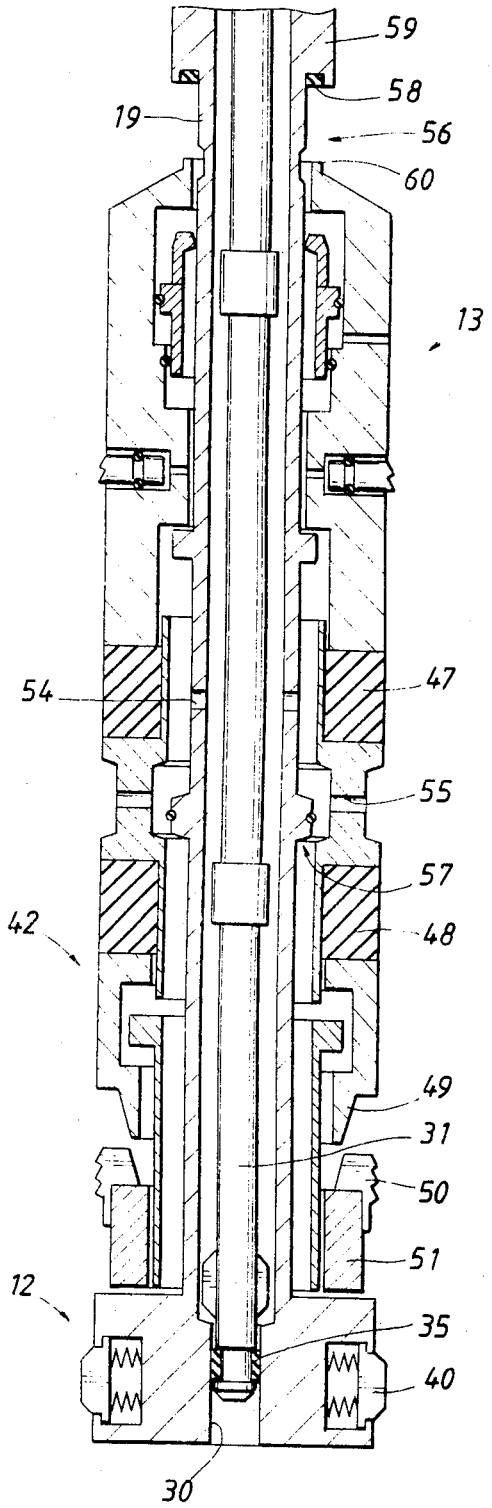

Turning now to FIGS. 2A–2B, a new and improved fluid-treating tool 10 arranged in accordance with the principles of the present invention is shown as it will appear when it has been coupled to a tubing string 80 and is ready to be lowered into a cased production well. In the depicted running-in position of the fluid-treating tool 10, the mandrel 14 of the upper valve means 11 is secured in its lower or telescoped position in relation to the valve body 15 and the packer mandrel 19 is secured in its extended position in relation to the settable packer assembly 42. Thus, with the mandrels 14 and 19 secured in their respective running-in positions, the upper full-bore valve means 10 as well as the upper and lower packer bypass valve means 56 and 57 are open, the packer elements 47 and 48 as well as the slips are maintained in their respective retracted positions.

As has been previously described, once the treating apparatus 10 has been positioned in a well bore where the packer elements 47 and 48 are to be set and the slips 50 engaged against the casing wall, the tubing string 80 is turned slightly to move the packer J-pin 52 out of the locking portion 53 of the packer J-slot and into the longer J-slot portion (none of which are seen in FIGS. 2A–2B). The valve mandrel 14 is not moved at this time from its telescoped position. Once the mandrel 19 is picked up and turned, the packer mandrel is then free to move further downwardly in relation to the packer bodies 48–51 of the settable packer assembly 42. With the packer drag blocks 51 are initially engaged with the casing wall of the well bore 80, the downward travel of the packer mandrel 19 moves the expander 49 against the slips to displace them outwardly. It should be also noted that the frictional engagement of the keys 40 with the casing wall is not sufficient to keep the packer mandrel 19 from being moved in relation to the settable packer assembly 42. It should also be recalled from the preceding description of the straddle packer 13 that the downward travel of the mandrel 19 will expand the upper and lower packer elements 47 and 48 into sealing engagement with the well casing as well as close the upper and lower bypass valve means 56 and 57. Thus, once the packer elements 46 and 47 are set and the bypass valve means 56 and 57 closed, the only fluid communication between the interior of the straddle packer 13 and the well bore 80 will be by way of the fluid discharge ports 54 and 55.

Those skilled in the art will, of course, appreciate that the fluid-treating apparatus 10 can be operated in several different ways. However, in the preferred sequence of operation, with the treating apparatus 10 in the running-in position that is depicted in FIGS. 2A–2B, the apparatus is lowered into a well bore with the J-pin 20 (not seen in FIGS. 2A–2B) still securing the mandrel 14 of the upper full-bore valve means 11 in the telescoped position and with the J-pin 52 (not seen in FIGS. 2A–2B) securing the packer mandrel 19 in its elevated position shown in FIGS. 2A–2B. Although a treating operation could be initiated at this time, it is instead preferred to first check for leaks in the tubing string 80 as well as test the operating condition of the treating apparatus 10 before the treating fluids are introduced into the tubing string. To conduct these tests, the treating apparatus 10 is preferably halted at some location above the uppermost perforations in the well bore. The straddle packer 13 is set as described above and pressure is applied at the surface to the well bore annulus to check the effectiveness of the upper bypass valve means 56 as well as to determine that the upper packer element 47 is in condition to make sealing engagement with the casing. Pressure is then applied to the tubing string 80 for testing the effectiveness of the lower bypass valve means 57 as well as to establish whether the lower packer element 48 is able to make a sealing engagement with the wall of the casing.

The tubing string 80 is then operated to unseat the straddle packer 13 and return the packer J-pin 52 to the locking portion 53 of the packer J-slot 53. The treating apparatus 10 is then repositioned below the lowermost perforations in the well bore and the packer 13 is reset-pressure is again applied to the tubing string 80 to test the sealing engagement of the lower packer element 48 as well as the effectiveness of the upper and lower bypass valve means 56 and 57 and the sealing engagement of the lower valve element 35 in its associated seat 30. The latter test will, of course, require that the upper valve element 36 on the elongated rod 31 be above the upper valve seat 26. With these tests completed, the tubing string 80 can then be moved to unjay the upper J-pin 20 and then raise the mandrel 14 of the upper full-bore valve means 11 to seat the upper valve element 36 in its seat 26 so that pressure can be applied to the tubing string for testing the upper full-bore valve means 11 as well as for checking for leaks in the tubing string itself. It should, of course, be recognized that this latter test can be made at any time as tubing joints are being successively added to the tubing string 80 to lower the treating apparatus 10 into the well bore.

Figure 3A:
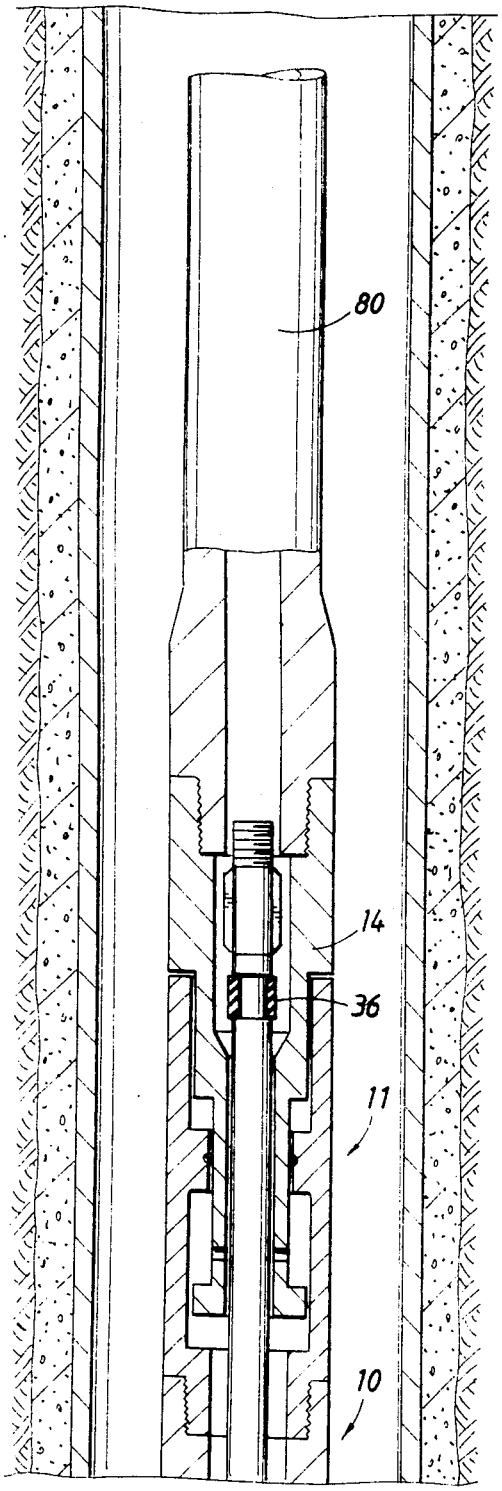
Figure 3B:
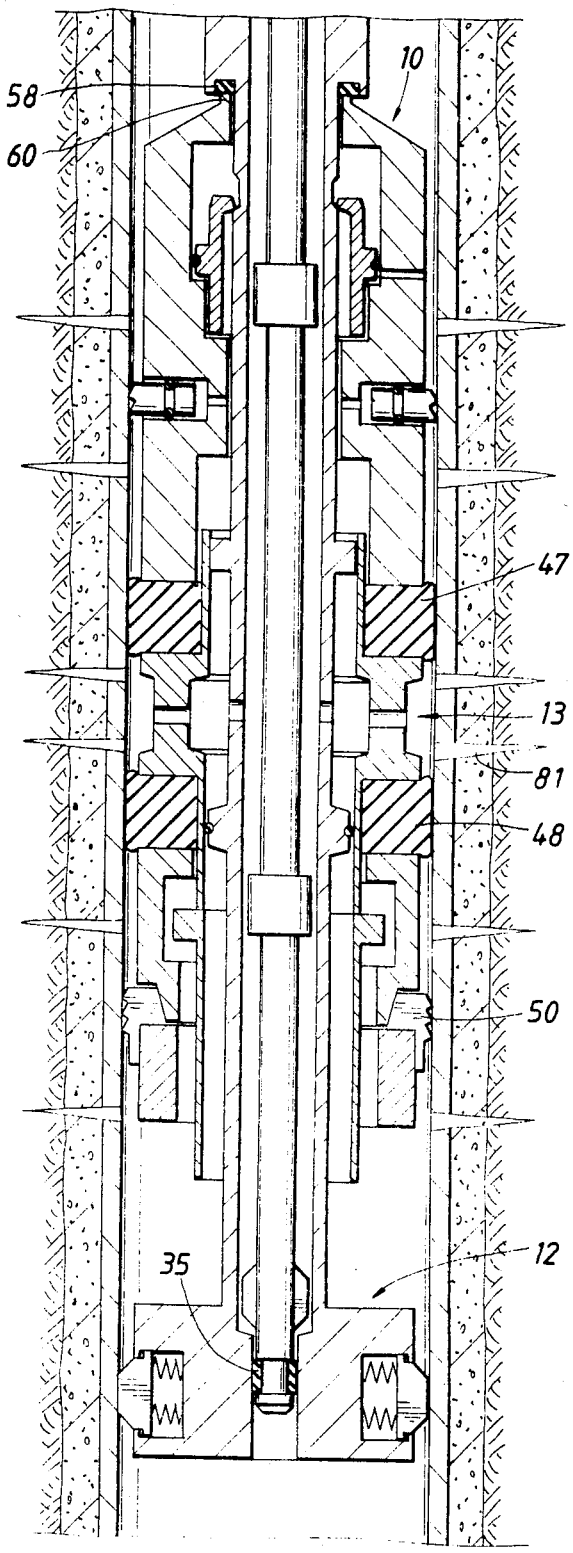

Once it is determined that all components of the fluid-treating apparatus 10 are functioning properly and that there is no leakage in the tubing string 80, the treating operation is commenced by moving the treating apparatus in the well bore until the collar locator keys 40 enter the recess in a casing collar which is known to be at a given depth location below the first set of perforations that are to be treated. Since the distance between the collar locator keys 40 and the fluid-discharge ports 55 is always known, the operator can readily raise the treating apparatus 10 as needed for accurately positioning the packer elements 47 and 48 so that they will straddle any given set of perforations. With the packer 13 still unseated, the treating fluid is then pumped into the tubing string 80 for displacing any unwanted fluids out of the tubing, through the ports 54, and back up through the still-open upper bypass valve means 56. Once it is believed that at least most of these unwanted fluids have been displaced from the tubing string 80, as seen in FIGS. 3A–3B the tubing string is moved downwardly for setting the packer 13 with the packer elements 47 and 48 straddling the perforations, as at 81, which are to be treated. The pumping of the treating fluids is continued until it is believed that a sufficient quantity of treating fluids has been displaced into the earth formations in communication with the isolated perforations.

Figure 4A:
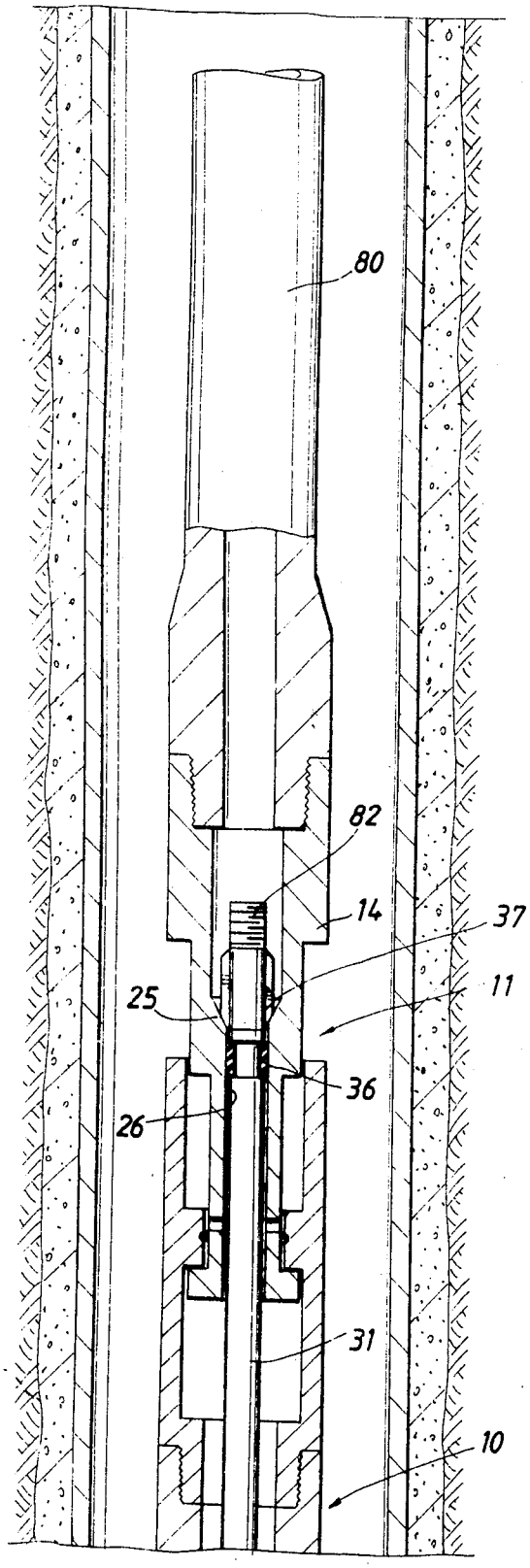
Figure 4B:
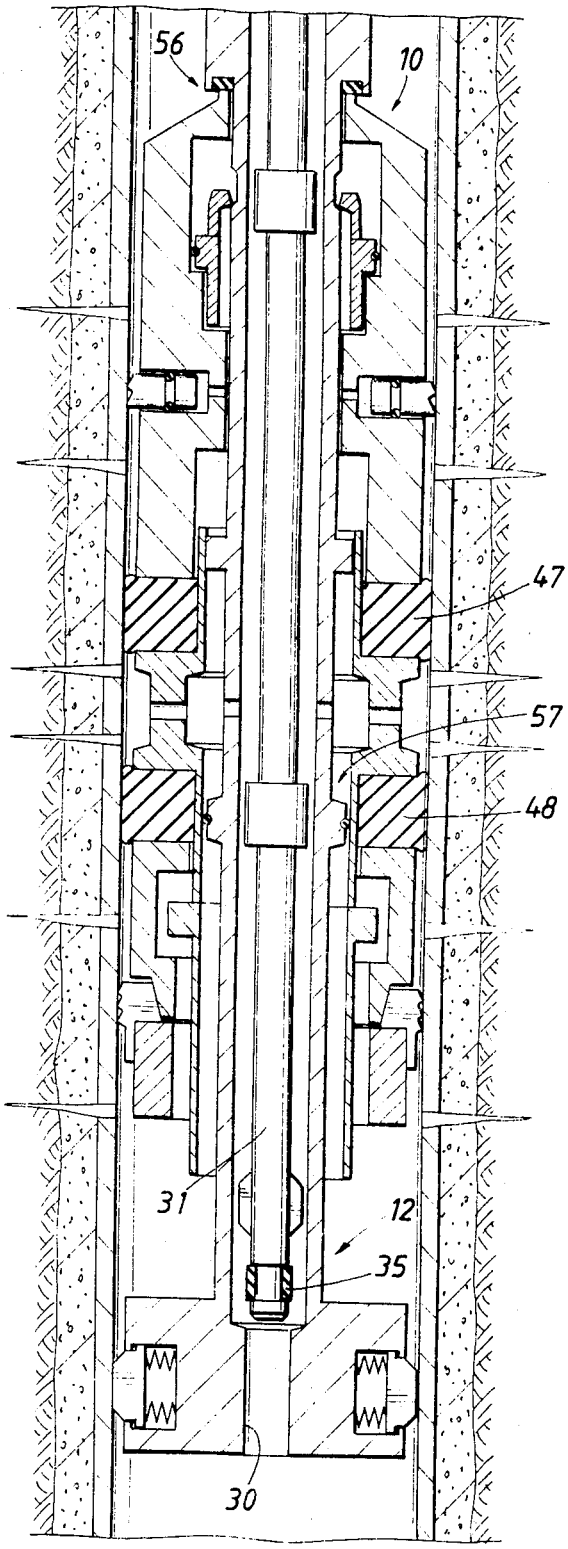

Once the first treating operation is concluded, the tubing string 80 is then raised sufficiently to elevate the mandrel 14 to its extended position. As depicted in FIGS. 4A–4B, the packer elements 47 and 48 are still engaged and the upper and lower bypass valve means 56 and 57 remain closed. Thus, as the mandrel shoulder 25 engages its associated shoulder 37 on the rod 31, the elongated rod will be elevated for seating the upper sealing member 36 in its valve seat 26 within the mandrel 14 of the upper valve means 11 and simultaneously raising the lower sealing member 35 out of its valve seat 30 in the lower valve means 12. With the elongated rod 31 in its elevated position, the treating fluids still remaining in the tubing string 81 will be safely trapped in the tubing string so as to not waste them. There will, of course, be some minor amount of treating fluids left in the treating apparatus 10 and these unused fluids will be drained into the well bore by way of the now-open lower full-bore valve means 12. Once this is accomplished, the tubing string 80 can be picked up further so as to unseat the straddle packer 13.

At this point, the treating tool 10 can, of course, be readily repositioned at a different location in the well bore for conducting another treating operation. Alternatively, once the treating fluids are pumped out of the tubing string 80, the rod 31 can be easily retrieved from the treating apparatus 10 by lowering a typical grapple or wireline fishing tool (not depicted in the drawings) into the tubing string 80 to catch the fishing neck 82 on top of the elongated rod. Once the elongated rod 31 is retrieved from the tubing string 80, the axial bore of the treating apparatus 10 will be left completely open so that if it is necessary wireline equipment such as a small-diameter logging tool or a through-tubing perforator (neither of which is shown in the drawings) can be lowered through the tubing string 80 and into the well bore below the treating apparatus. With the rod 31 removed from the treating apparatus 10, it will also be possible to carry out additional completion operations such as acidizing or fracturing in the well bore below the apparatus. Once these other operations have been completed, the elongated rod 31 can be readily replaced in the treating apparatus 10 either by lowering the rod on a sand line or by simply dropping the rod into the surface end of the tubing string 80 so that it will move into position in the upper and lower full-bore valve bodies 15 and 27.

In any event, once the treating operations have been completed and the elongated rod 31 has been replaced in the upper and lower full-bore valve bodies 15 and 27, the new and improved fluid treating apparatus 10 is in condition to be returned to the surface. It will, of course, be recognized that the quantity of unused treating fluids which are left in the tubing string 80 can be regulated so as to leave a small quantity of the fluids in the tubing string at the conclusion of the final treating operation. Thus, at the conclusion of the last treating operation, it is preferred to move the tubing string 80 so as to lock the upper full-bore valve means 11 open so that as the tubing string is pulled from the well bore and successive stands or joints of pipe are broken loose at the surface, the fluids in the tubing string will be drained through the upper full-bore valve means and the upper and lower packer bypass valves 56 and 57.

From the preceding description of the new and improved treating apparatus 10 of the present invention and its typical mode of operation, it will be recognized that the depicted packer 13 is so arranged that the upper and lower packer elements 47 and 48 will always be successively set as the tubing string 80 is lowered in relation to the straddle packer assembly 42. Thus, as previously described, after the treating apparatus 10 has been tested and as a treating operation is commenced, the packer 13 is preferably not set until the treating fluids have displaced any unwanted fluids out of the tubing string 81 and into the annulus of the well bore. Ordinarily this presents no particular problem in the operation of the treating apparatus 10 unless the internal walls of some of the tubing joints in the tubing string 80 are coated with rust or scale that could be loosened by the treating fluids. Those skilled in the art will, of course, recognize that it would be inadvisable to treat a given formation interval with a treating fluid carrying a substantial quantity of loosened rust or scale particles. With the straddle packer 13 arranged as it is depicted in FIGS. 1C–1E, the only preventative measure that can be taken to avoid forcing some of these loosened materials into the formations being treated is to use an acid to displace the unwanted fluids from the tubing string 80 with the hope that these loosened materials would be carried to the surface by way of the well bore annulus. This is, of course, not the best way to remove such unwanted materials from the tubing string 80.

Figure 5:
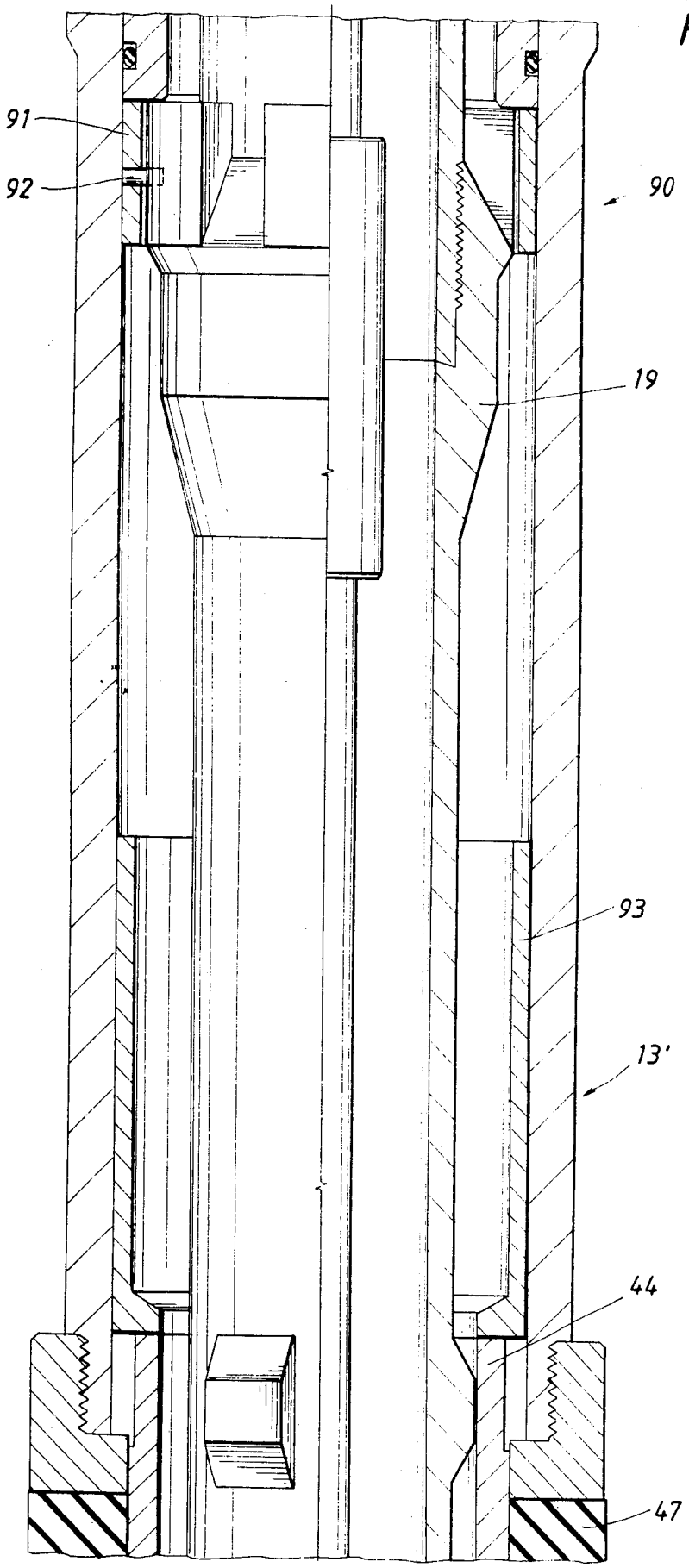
FIG. 5 shows an alternative embodiment of the packer seen in FIGS. 1C–1E.

Accordingly, to overcome this problem, the new and improved fluid-treating apparatus 10 of the present invention can be alternatively arranged so that the lower packer element 48 of the straddle packer 13 can be initially set independently of the the upper packer element 47. Thus, as shown generally at 13' in FIG. 5, the packer means 13 can be modified by providing means, as shown generally at 90, for releasably securing the upper packer element 47 from being expanded into engagement with the casing wall until the lower packer element 48 (not seen in FIG. 5) has been expanded into engagement with the casing wall. As illustrated, the releasable means 90 are comprised of a sleeve member 91 that is secured to the packer mandrel 19 by one or more shear pins 92 and adapted to engage an elongated sleeve member 93 that is mounted on top of the intermediate packer body 44. The upper end of the packer body 44 could, of course, be modified to provide a substitute for the sleeve 93 but it is preferred to utilize a removable sleeve for that purpose. With these two sleeves 91 and 93 arranged as depicted in FIG. 5, it will be appreciated that upon downward movement of the packer mandrel 19, the sleeves will be abutted with one another and effectively transfer the downward forces around the upper packer element 47 so that the lower packer element 48 will be set independently of the upper element.

Accordingly, it will be necessary to apply an increased downward force of sufficient magnitude to fail the shear pins 92 before the upper packer element 47 can be set. With the addition of the selectively-releasable means 90 to the straddle packer 13, it will be appreciated that the operation of this alternative embodiment of the treating apparatus 10 with the packer 13' can be adapted to flush out loosened scale and rust from the tubing string 80 before a treating operation is commenced as previously described. To accomplish this, once the treating apparatus 10 and the tubing string 80 have been checked as described above, the modified treating apparatus is positioned in the well bore above the uppermost perforations and the tubing string is then manipulated as needed to unjay the lower J-pin 52 and apply a downward force on the packer mandrel 19. As previously described by applying only a limited force onto the packer mandrel 19, the release means 90 will function to keep the upper packer element 47 from being expanded as the downward movement of the packer mandrel expands the lower packer element 48 against the casing wall. Once the lower element 48 is set, the perforations below the packer 13' are isolated and acid and other cleaning fluids can be circulated back and forth through the tubing string 80 and the annulus of the well bore as needed to thoroughly clean the interior of the tubing string before commencing the treating operations. Once the tubing string 80 is believed to be clean, the tubing string can slacked off to impose additional force on the packer mandrel 19 and ultimately fail the shear pins 91 so that the upper packer element 47 is then freed so that thereafter it can be set in conjunction with the lower packer element 48. From this point on, the operation of the treating apparatus 10 with the modified packer 13' will be as previously described.

While only a particular embodiment of the invention has been shown and described, it is apparent that various changes and modifications may be made without departing from the principles of the present invention in its broader aspects; and, therefore, the aim in the appended claims is to cover all such changes and modifications as fall with the true spirit and scope of this invention.

What is claimed is:

1. Fluid-treating apparatus adapted to be dependently coupled from a pipe string and lowered into a well bore penetrating a plurality of earth formations and comprising:

upper and lower tubular members telescopically arranged together for longitudinal movement relative to one another between a telescoped position and an extended position;

upper and lower valve means including upper and lower annular valve seats respectively arranged in said upper and lower tubular members, and a movable valve member coaxially arranged within the axial bores of said tubular members, said valve member including upper and lower valve heads respectively carrying sealing means adapted for being seated in said upper and lower valve seats and an intermediate portion cooperatively arranged and sized for said lower valve head to be seated in said lower valve seat with said upper valve head above said upper valve seat when said telescoped members are in their said telescoped position and for said upper valve head to be seated in said upper valve seat with said lower valve member above said lower valve seat when said telescoped members are in their said extended position;

straddle-packer means including upper and lower packer elements cooperatively arranged around said lower tubular member and adapted for isolating an adjacent well bore interval disposed between said packer elements; and fluid-discharge means adapted for communicating said axial bores of said tubular members between said valve seats with an isolated well bore between said packer elements.

2. The fluid-treating apparatus of claim 1 wherein said packer elements are normally-contracted elastomeric elements that are respectively adapted to be radially expanded into sealing engagement with an adjacent well bore wall; and said straddle-packer means further include means operable upon movement of said telescoped members to one of their said positions for expanding said packer elements into sealing engagement with an adjacent well bore wall and operable upon movement of said telescoped members to the other of their said positions for restoring said packer elements to their initial contracted conditions.

3. The fluid-treating apparatus of claim 2 wherein said one position of said telescoped members is their said telescoped position and said other position of said telescoped members is their said extended position.

4. The fluid-treating apparatus of claim 2 wherein said valve means further include means operable upon movement of said telescoped members toward their said extended position for seating said upper valve head in said upper valve seat before said telescoped members reach their said extended position.

5. The fluid-treating apparatus of claim 1 wherein said upper valve seat is larger in diameter than said lower valve seat so that said valve member can be selectively removed from said telescoped members to leave their said axial bores unobstructed.

6. The fluid-treating apparatus of claim 1 wherein said packer elements are respectively adapted to be expanded outwardly into sealing engagement with an adjacent well bore wall; and said straddle-packer means further include means operable upon movement of said telescoped members to their said telescoped position for expanding said packer elements outwardly into sealing engagement with an adjacent well bore wall and operable upon movement of said telescoped members to their said extended position for disengaging said packer elements from the adjacent well bore wall.

7. The fluid-treating apparatus of claim 6 wherein said valve means further include means operable upon movement of said telescoped members toward their said extended position for moving said valve member to seat said upper valve head in said upper valve seat before said packer elements have been disengaged from the adjacent well bore wall.

8. The fluid-treating apparatus of claim 6 wherein said upper valve seat is larger in diameter than said lower valve seat so that said valve member can be selectively removed from said telescoped members to leave their said axial bores unobstructed.

9. The fluid-treating apparatus of claim 1 wherein said packer elements are normally-contracted elastomeric elements that are respectively adapted to be expanded outwardly into engagement with an adjacent well bore wall; and said straddle-packer means further include actuating means operable by the initial movement of said telescoped members toward their said telescoped position for expanding said lower packer element outwardly into sealing engagement with an adjacent well bore wall and operable by the continued movement of said telescoped members to their said position for expanding said upper packer element outwardly into engagement with an adjacent well bore wall.

10. The fluid-treating apparatus of claim 9 wherein said actuating means are also operable by the movement of said telescoped members toward their said extended position for retracting said upper and lower packer elements.

11. Formation-treating apparatus adapted to be dependently suspended from a pipe string in a well bore and positioned therein for directing treating fluids into earth formations in communication therewith and comprising:

body means defining an unobstructed full-bore axial passage and including an upper tubular body adapted to be tandemly coupled to a pipe string and a lower tubular body cooperatively receiving said upper body for movement therein between spaced upper and lower operating positions;

packer means cooperatively supported by said lower body and adapted for isolating a selected interval of a well bore from well bore fluids; and means adapted for controlling communication between a pipe string coupled to said upper body and a well bore interval isolated by said packer means and including passage means for communicating an intermediate portion of said full-bore passage with a well bore interval isolated by said packer means, an upper annular valve seat in said upper body above said intermediate portion of said full-bore passage, a lower annular valve seat arranged in said lower body below said intermediate portion of said full-bore passage, and an elongated retrievable valve member loosely fitted in said full-bore passage having end portions with upper and lower valve heads cooperatively arranged thereon for seating engagement with said upper and lower valve seats respectively and an intermediate portion having a length selected so that when said upper body is in its said lower operating position, said lower valve head will be seated on said lower valve seat to support said upper valve head above said upper valve seat for establishing communication between a pipe string coupled to said upper body with said intermediate portion of said full-bore passage and when said upper body is in its said upper operating position, said upper valve head will be seated on said upper valve seat to suspend said lower valve head above said lower valve seat for closing communication between a pipe string coupled to said upper tubular member and said intermediate portion of said full-bore passage.

12. The formation-treating apparatus of claim 11 wherein said packer means are adapted to be expanded into sealing engagement with a well bore wall; and said packer means further include means operable upon downward movement of said upper body for expanding said packer means into sealing engagement with a well bore wall and operable upon upward movement of said upper body for disengaging said packer means.

13. The formation-treating apparatus of claim 12 wherein said packer means include separate spatially-disposed elastomeric elements arranged to isolate a selected well bore interval between said elastomeric elements.

14. The formation-testing apparatus of claim 11 wherein said upper valve seat is larger in diameter than said lower valve seat to facilitate the removal of said valve member.

15. The formation-treating apparatus of claim 13 further including fluid-bypass means operable upon downward movement of said upper body for closing fluid communication between said full-bore passage and well bore fluids exterior of said body means and operable upon upward movement of said upper body for establishing communication between said full-bore passage and well bore fluids exterior of said body means.

16. The formation-treating apparatus of claim 13 wherein said packer means include separate spatially-disposed elastomeric elements arranged to isolate a selected well bore interval between said elastomeric elements; and said formation-treating apparatus further includes upper and lower fluid-bypass means operable upon downward movement of said upper body for closing fluid communication between said full-bore passage and well bore fluids exterior of said body means above and below said elastomeric elements and operable upon upward movement of said upper body for establishing communication between said full-bore passage and well bore fluids exterior of said body means above and below said elastomeric elements.

17. The formation-treating apparatus of claim 12 further including means operable upon upward movement of said upper body for seating said upper valve head in said upper valve seat and suspending said lower valve head above said lower valve seat before disengaging said packer means.

18. The formation-treating apparatus of claim 11 wherein said packer means include separate spatially-disposed elastomeric elements adapted to be expanded outwardly into sealing engagement with a well bore wall to isolate a selected well bore interval between said elastomeric elements; and said formation-treating apparatus further includes actuating means operable upon the initial downward movement of said upper body for expanding said lower elastomeric element into sealing engagement with a well bore wall and operable upon continued downward movement of said body for subsequently expanding said upper elastomeric element into sealing engagement with a well bore wall.

19. The formation-treating apparatus of claim 18 wherein said actuating means include means limiting continued downward movement of said upper body until a force of at least a predetermined magnitude has been imposed on said upper body.

* * * * *